United States Patent [19]

Uehori et al.

[11] 4,331,489

[45] May 25, 1982

[54] PROCESS FOR PRODUCING MAGNETIC POWDER

[75] Inventors: Tatsuo Uehori; Akio Watanabe; Tosiaki Ide, all of Tokyo, Japan

[73] Assignee: TDK Electronics Co., Ltd., Tokyo, Japan

[21] Appl. No.: 204,718

[22] Filed: Nov. 6, 1980

[30] Foreign Application Priority Data

Nov. 28, 1979 [JP] Japan ..... 54-152915

[51] Int. Cl.[3] ..... H01F 1/02

[52] U.S. Cl. ..... 148/105; 75/0.5 AA; 148/108

[58] Field of Search ..... 75/0.5 AA; 148/103, 148/105, 108

[56] References Cited

U.S. PATENT DOCUMENTS 3,756,866 9/1973 Parker et al. ..... 75/0.5 AA
4,076,861 2/1978 Furukawa et al. ..... 75/0.5 AA
4,096,316 6/1978 Tamai et al. ..... 148/108
4,113,528 9/1978 Tokuoka et al. ..... 75/0.5 AA
4,221,614 9/1980 Yoda et al. ..... 75/0.5 AA

*Primary Examiner*—John P. Sheehan
*Attorney, Agent, or Firm*—Oblon, Fisher, Spivak, McClelland & Maier

[57] ABSTRACT

A magnetic powder is produced by mixing an aqueous solution of a metal salt with an aqueous solution of a reducing agent such as sodium boron hydride in a magnetic field to reduce said metal salt to continuously form a magnetic powder and heat-treating said magnetic powder in a non-oxidative atmosphere. The aqueous solution of a metal salt is mixed with said aqueous solution of a reducing agent in a magnetic field to continuously discharge a reaction mixture containing a magnetic powder having pH of 2.5 or lower from a reactor and said reaction mixture containing said magnetic powder is immediately continuously washed and filtered and said magnetic powder is heat-treated in said non-oxidative atmosphere.

3 Claims, 2 Drawing Figures

PROCESS FOR PRODUCING MAGNETIC POWDER

BACKGROUND OF THE INVENTION

1. Field of the Invention

The present invention relates to a process for producing a magnetic powder. More particularly, it relates to a process for producing a magnetic powder having excellent magnetic characteristics.

2. Description of the Prior Arts

Various magnetic powders used for magnetic recording media such as a magnetic tape have been proposed. Typical magnetic powders include acicular $\gamma$-$Fe_2O_3$, acicular $Fe_3O_4$ or cobalt-doped or cobalt-adsorbed acicular $\gamma$-$Fe_2O_3$ or $Fe_3O_4$ or metallic powders such as acicular metallic iron. Recently, the metallic powders have been practically used in view of high density recording. The metallic magnetic powders can be produced by reducing iron oxide in hydrogen gas or an inert gas by carrying out a wet reduction process from an aqeuous solution of an iron salt with or without another salt such as a cobalt salt.

It has been known as a wet reduction process, to produce a magnetic powder as a product by mixing an aqueous solution of a metal salt with an aqueous solution of a reducing agent such as sodium boron hydride in a magnetic field to reduce the metal salt so as to continuously form a metallic magnetic powder and heat-treating the resulting magnetic powder in a non-oxidative atmosphere. In this process, it has been found to cause sintering between metallic particles during the heat-treatment in the non-oxidative atmosphere to cause the deterioration of the magnetic characteristics.

The phenomenon has been studied to find the fact that the melt-bonding of the metallic particles is accelerated during the heat-treatment because a boron component used in the wet reduction process is remained in the magnetic powder.

It has been further found that a magnetic tape prepared by using a metallic magnetic powder having relatively high boron content, has a disadvantage of inferior stability in the condition of high humidity and high temperature such as 50° C. 90 RH to cause variation in storage. The variation in storage should be prevented since it may gradually cause even in the normal condition. The adverse effect of the boron component to the magnetic characteristics has been found by the inventor and has not been previously found.

SUMMARY OF THE INVENTION

It is an object of the present invention to provide a process for producing a magnetic powder by a wet reduction process to obtain a metallic magnetic powder which imparts stable magnetic characteristics of a magnetic recording medium in conditions of high humidity and high temperature.

The foregoing and other objects of the present invention have been attained by producing a magnetic powder by mixing an aqueous solution of a metal salt with an aqueous solution of a reducing agent such as sodium boron hydride in a magnetic field to continuously discharge a reaction mixture containing a magnetic powder having pH of 2.5 or lower from a reactor and immediately washing and filtering the magnetic powder and heat-treating the magnetic powder in a non-oxidative atmosphere.

DETAILED DESCRIPTION OF THE PREFERRED EMBODIMENTS

Figure 1:
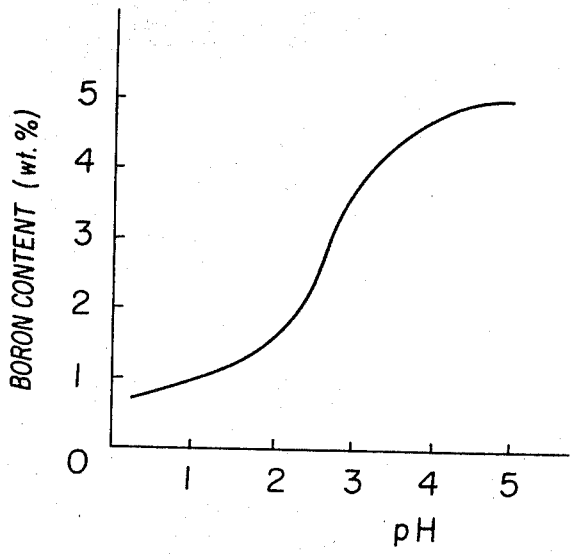
FIG. 1 is a graph showing the relation of pH at an outlet of a reactor and a boron content.

It has been studied to decrease the boron content of the magnetic powder to succeed in the preparation of the magnetic powder having excellent stable magnetic characteristics by decreasing the boron content by a special treatment of the metallic magnetic powder before the heat-treatment.

In accordance with the process of the present invention, an aqueous solution of a metal salt is mixed with an aqueous solution of a reducing agent such as sodium boron hydride in a magnetic field to control the condition in a reactor to give 2.5 or lower of pH of a solution containing a magnetic powder discharged from the reactor and the magnetic powder is immediately continuously washed and filtered and heat-treated in non-oxidative atmosphere.

Slight dissolution of the magnetic powder is resulted by adjusting pH of the solution containing the magnetic powder to 2.5 or lower at the outlet of the reactor, however the dissolution is substantially prevented by immediately washing the magnetic powder discharged from the reactor, with water. It has been found that the coercive force Hc of the magnetic powder is highly decreased by the heat-treatment in the non-oxidative atmosphere in the case of pH of higher than 2.5.

In the conventional wet reduction process, pH of the solution containing the magnetic powder is about 4.0 at the outlet of the reactor. When the magnetic powder is washed with water and dehydrated and dried and heat-treated in the non-oxidative atmosphere, only magnetic characteristics of a coercive force Hc of 1450 Oe and a residual magnetic flux density $\delta r$ or 70 emu/g are given. In accordance with the present invention, the magnetic characteristics of a coercive force Hc of more than 1700 Oe and a residual magnetic flux density $\delta r$ of more than 75 emu/g can be given. The significant advantage of the present invention is to provide a magnetic tape having high stability by remarkably decreasing the variation in storage when the magnetic tape is prepared by using the magnetic powder.

The present invention will be illustrated by certain examples and references which are provided for purposes of illustration only and are not intended to be limiting the invention.

EXAMPLE 1

Aqueous solution of metal salt:

| | |
|---|---|
| 70 liter of solution of ferrous sulfate at 1.0 mol/l<br>30 liter of solution of cobalt sulfate at 1.0 mol/l | A-1 solution |

Aqueous solution of reducing agent:

| | |
|---|---|
| 100 liter of solution of sodium boron hydride at 1.0 mol/l | B-1 solution |

A-1 solution and B-1 solution were continuously fed at equal volumetric rate into a reactor to mix them in a magnetic field of 800 Oe to react them. In A-1 solution, sulfuric acid was added so as to adjust pH of the solution containing the magnetic powder at the outlet of the reactor, to be 2.0±0.1. The magnetic powder discharged from the reactor was immediately washed with water and filtered and heat-treated in hydrogen gas flow at 390° C. for 1 hour.

The resulting magnetic powder had the following magnetic characteristics.

Hc: 2100 Oe

δr: 80 emu/g

EXAMPLE 2

Aqueous solution of metal salt:

| | |
|---|---|
| 80 liter of solution of ferrous sulfate at 1.0 mol/l<br>20 liter of solution of cobalt sulfate at 1.0 mol/l | A-2 solution |

Aqueous solution of reducing agent:

| | |
|---|---|
| 100 liter of solution of sodium boron hydride at 1.0 mol/l | B-2 solution |

A-2 solution and B-2 solution were continuously fed at equal volumetric rate in a reactor to mix them in a magnetic field of 700 Oe to react them. In A-2 solution, hydrochloric acid was added as as to adjust pH of the solution containing the magnetic powder at the outlet of the reactor to be 1.0±0.1. The magnetic powder discharged from the reactor was immediately washed with water and filtered and heat-treated in hydrogen gas flow at 400° C. for 1 hour.

The resulting magnetic powder had the following magnetic characteristics.

Hc: 1900 Oe

δr: 75 emu/g

EXAMPLE 3

Aqueous solution of metal salt:

| | |
|---|---|
| 60 liter of solution of ferrous sulfate at 1.0 mol/l<br>40 liter of solution of cobalt sulfate at 1.0 mol/l | A-3 solution |

Aqueous solution of reducing agent:

| | |
|---|---|
| 100 liter of solution of sodium boron hydride at 1.0 mol/l | B-3 solution |

A-3 solution and B-3 solution were continuously fed at equal volumetric rate into a reactor to mix them in a magnetic field of 1000 Oe to react them. In A-3 solution, hydrochloric acid was added so as to adjust pH of the solution containing the magnetic powder at the outlet of the reactor to be 1.5±0.1. The magnetic powder discharged from the reactor was immediately washed with water and filtered and heat-treated in hydrogen gas flow at 450° C. for 2 hours.

The resulting magnetic powder had the following magnetic characteristics.

Hc: 1800 Oe

δr: 75 emu/g

When pH of the solution containing the magnetic powder discharged from the reactor was 2.5 or lower, the magnetic power slightly dissolved however the boron content in the magnetic powder was decreased whereby the sintering was not substantially caused in the next step of the heat-treatment and the variation in storage was decreased.

EXAMPLE 4

In the process of Example 1, pH of the reaction mixture at the outlet of the reactor was adjusted by adding sulfuric acid to the aqueous solution of a metal salt, and the boron contents of the samples of the magnetic powders were tested and the variations in storage of the resulting magnetic tapes prepared by using each magnetic powder were tested in the condition of 50° C. and 95% RH.

Figure 2:
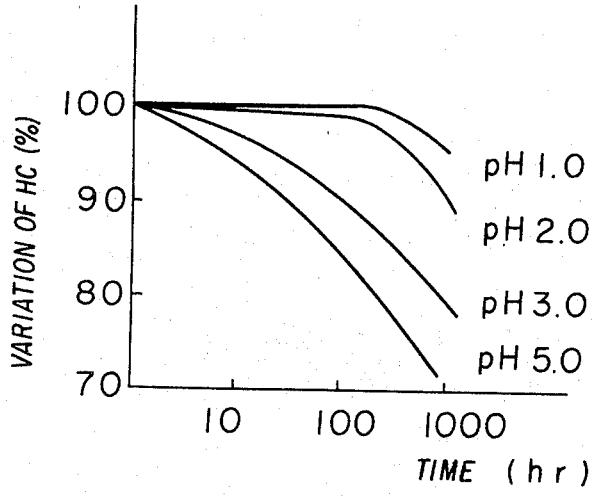
FIG. 2 is a graph showing variations of coercive forces of magnetic tapes in storage.

FIG. 1 shows the relation of pH and the boron content. FIG. 2 shows the variations of coercive force Hc in storage. The boron content is decreased in the case of pH of 4 or lower. Thus, the coercive force Hc is decreased for more than 10% in the storage for 100 hours in the case of pH of 3 or higher. Therefore, it is necessary to be pH of 2.5 or lower.

We claim:

1. In a process for producing a metallic magnetic powder of decreased boron content by mixing an aqueous solution of a metal salt with an aqueous solution of a reducing agent comprising sodium boron hydride in a magnetic field to reduce said metal salt to continuously form a metallic magnetic powder and heat-treating said metallic magnetic powder in a non-oxidative atmosphere, the improvement characterized in that said aqueous solution of a metal salt is mixed with said aqueous solution of fluid reducing agent in a magnetic field to continuously discharge a reaction mixture containing a metallic magnetic powder having a pH of 2.5 or lower, and said reaction mixture containing said metallic magnetic powder is immediately continuously washed and filtered and said metallic magnetic powder is heat-treated in said non-oxidative atmosphere.

2. The process according to claim 1 wherein an acid is incorporated in said aqueous solution of a metal salt.

3. The process according to claim 1 wherein said metal salt is a ferrous salt with or without a cobalt salt.

* * * * *